United States Patent [19]

Pataut et al.

[11] Patent Number: 4,952,865

[45] Date of Patent: Aug. 28, 1990

[54] DEVICE FOR CONTROLLING TEMPERATURE CHARACTRISTICS OF INTEGRATED CIRCUITS

[75] Inventors: Gérard Pataut, Gif sur Yvette; Pierre Quentin, Paris, both of France

[73] Assignee: Thomson Composants Microondes, Puteaux, France

[21] Appl. No.: 453,865

[22] Filed: Dec. 20, 1989

[30] Foreign Application Priority Data

Dec. 23, 1988 [FR] France ..... 88 17091

[51] Int. Cl.[5] ..... G05F 3/16

[52] U.S. Cl. ..... 323/313; 307/491; 323/367; 323/907

[58] Field of Search ..... 307/310, 491; 323/313, 323/367, 907, 314

[56] References Cited

U.S. PATENT DOCUMENTS

| | | | |
|---|---|---|---|
| Re. 30,586 | 4/1981 | Brokaw | 323/314 |
| 3,887,863 | 6/1975 | Brokaw | 323/314 |
| 4,020,367 | 4/1977 | Yamashiro et al. | 307/304 |
| 4,087,758 | 5/1978 | Hareyama | 323/314 |
| 4,263,519 | 4/1981 | Schade | 307/310 |
| 4,622,512 | 11/1986 | Brokaw | 323/907 |
| 4,723,108 | 2/1988 | Murphy et al. | 307/304 |
| 4,882,533 | 11/1989 | Kelley | 323/313 |
| 4,883,992 | 11/1989 | Koglin et al. | 307/491 |

FOREIGN PATENT DOCUMENTS 2136649 9/1984 United Kingdom .

OTHER PUBLICATIONS

Patent Abstracts of Japan, vol. 10, No. 298 (P-505), (2354), Oct. 9, 1986, & JP-A-61 115113 (NEC Corp.), Jun. 2, 1986.

*Primary Examiner*—Steven L. Stephan
*Assistant Examiner*—Jeffrey Sterrett
*Attorney, Agent, or Firm*—Oblon, Spivak, McClelland, Maier & Neustadt

[57] ABSTRACT

A circuit dedicated to the stabilization of integrated circuit temperature charactristics is achieved by integrating on the same semiconductor material chip as the integrated circuit and a device comprised of a sensor having at least two resistors (R1, R2 and/or R3, R4) supplied between two voltages (DC1, DC2) used alone or in conjunction with differential circuit structure (T2, T3) supplied by a current source (T1), comprising a transistorized variable load impedance (T4, T5, T6, T7). The resistors have different temperature coefficients, and the output voltage (VA or VB) of the bridge is temperature dependent. The integrated must incorporate a voltage-controlled element (transistor or diode).

3 Claims, 1 Drawing Sheet

DEVICE FOR CONTROLLING TEMPERATURE CHARACTRISTICS OF INTEGRATED CIRCUITS

BACKGROUND OF THE INVENTION

1. Field of the Invention

The present invention relates to a device for controlling the temperature characteristics of monolithic integrated circuits, and more particularly those fabricated from high-speed, group III-V materials such as GaAs.

The temperature behavior of circuits fabricated on group III-V substrates is an important parameter for the user. It should be taken into account by the circuit designer either by providing an accessible control electrode or by producing an on-chip device that corrects the temperature dependent variations of the circuit characteristics to be stabilized.

2. Description of the Prior Art

All methods currently employed act outside the circuit, either by regulating the ambient temperature or by using feedback control involving a temperature-dependent variable, generally by means of a voltage correcting a circuit parameter.

SUMMARY OF THE INVENTION

The temperature characteristic control device according to the present invention combines the control circuit with the circuit to be stabilized within a single homogeneous integrated circuit, e.g. on gallium arsenide. The two circuits are fabricated side-by-side on a common substrate using standard integrated circuit technology process steps. Temperature is detected directly on the substrate and serves to control a correcting voltage.

This technology uses at least two kinds of resistive elements having different temperature coefficients. Accordingly, it is possible to produce a divider bridge capable of producing a temperature-dependent voltage by combining these two types of elements. The controlled device itself must be susceptible of having its temperature drifts compensated by a dc voltage, e.g. by application of a gate biasing voltage for controlling the gain of a field-effect transistor.

More specifically, the present invention relates to a device, supported on a substrate, for controlling temperature characteristics of integrated circuits, wherein said device comprises at least one divider bridge formed by two resistors integrated on the substrate of the controlled circuit, said resistors being supplied between two voltages and having different temperature coefficients, preferably opposite, and said bridge delivering to the common point of said two resistors a temperature-dependent voltage used to control said integrated circuit to be stabilized.

BRIEF DESCRIPTION OF THE DRAWINGS

The present invention shall be more clearly understood from reading the following detailed description of a preferred embodiment in conjunction with the appended drawings in which.

DETAILED DESCRIPTION OF PREFERRED EMBODIMENTS

A measurement sensor of the device according to the present invention comprises two resistors R1 and R2 connected in a voltage divider bridge. The bridge is supplied at its two terminals by external, temperature-stable, dc voltage generators DC1 and DC2, one of whose voltages can be a 0 V potential of the circuit (ground).

The resistors R1 and R2 have different temperature coefficients $\alpha 1$ and $\alpha 2$. Their resistance variation as a function of temperature can be expressed as:

$$R_1=[1+\alpha_1(T-T_0)]R_{10}$$

with $$T_0=20^\circ \text{ C.}$$

$$R_{10}=R_1 \text{ for } T=20^\circ \text{ C.}$$

Likewise:

$$R_2=[1+\alpha_2(T-T_0)]R_{20}$$

The following substitutions shall be made for simplification:

$$\beta_T=1+\alpha_1(T-T_0)$$

$$\gamma_T=1+\alpha_2(T-T_0)$$

The output voltage Vc1 of the voltage divider is variable as a function of temperature and can be used to control the circuit.

The resistance values of the divider bridge can be computed from the following equations:

For $T = T_1$ $$\frac{R_{10}}{R_{20}} \cdot \frac{\beta T_1}{\gamma T_1} = \frac{DC1 - VC1(T_1)}{VC1(T_1) - DC2}$$

For $T = T_2$ $$\frac{R_{10}}{R_{20}} \cdot \frac{\beta T_2}{\gamma T_2} = \frac{DC1 - VC1(T_2)}{VC1(T_2) - DC2}$$

in the case of a field-effect transistor whose temperature drift can be modified by acting on its gate voltage from 0 V (at 80° C.) to −0.3 V (at −40° C.), the condition is:

$$T_1=-40^\circ \text{ C.} \rightarrow VC1(T_1)=-0.3 \text{ V}$$

$$T_2=+80^\circ \text{ C.} \rightarrow VC1(T_2)=0 \text{ V}$$

The following equation can be expressed:

$$\frac{R_{10}}{R_{20}} = -\frac{\gamma T_2}{\beta T_2} \cdot \frac{DC1}{DC2}$$

$$DC2 = \frac{-\frac{\beta T_1}{\gamma T_1} \cdot DC1 \cdot VC1(T_1)}{\frac{\beta T_2}{\gamma T_2} \cdot [DC1 - VC1(T_1)] - \frac{\beta T_1}{\gamma T_1} \cdot DC1}$$

By selecting a value for DC1, it is possible to compute the value of DC2 and the ratio of resistance values R1 and R2. The values of these resistors are determined by the acceptable degree of consumption in the controlled circuit with respect to the consumption of the control circuit.

The supply voltage values DC1 and DC2 can then serve as post adjustment means for the temperature control device.

Figure 1:
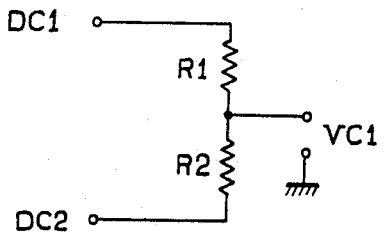
FIG. 1 is a circuit diagram of a detector incorporated on an integrated circuit chip.
Figure 2:
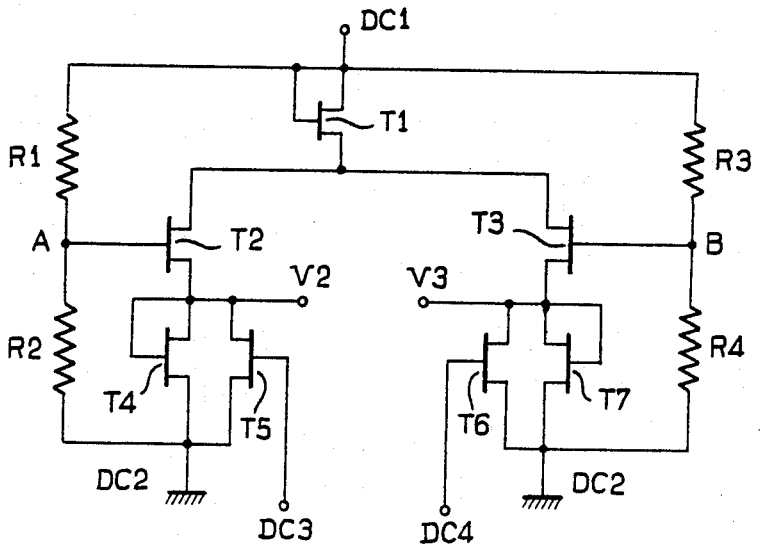
FIG. 2 is a circuit diagram of a differential structure supplying complementary temperature-dependent voltages.

There will now be considered a complete control device, including a sensor and shaping circuit, having the differential structure illustrated in FIG. 2. This circuit is integrated in the same semiconductor material chip as the temperature-controlled device. The temperature sensed directly on the substrate serves to control the gain of a differential structure supplying complementary temperature-dependent voltages.

In this way, the amplifier can be stabilized by controlling a stage of this automatic gain control amplifier. A dual-gate field effect structure can also be controlled if the controlling voltage is applied to the second gate. An oscillator can be temperature stabilized by applying a controlling voltage on a circuit varactor. Other applications can be envisaged so long as the controlling voltage can be applied on a transistor gate or on a diode.

The differential structure of FIG. 2 comprises two parts: a first part that detects temperature variations and a second part for shaping the signal that serves to drive the temperature-controlled circuit.

Temperature variations are detected by a resistor bridge balanced at a temperature $T_0$ (e.g. 20° C.) which supplies a voltage proportional to temperature and evolving therewith. This bridge is formed by resistors R1 and R2, supplied between DC1 and ground, and two other resistors R3 and R4 supplied in an identical manner. The resistors forming the bridge are diagonally connected and have opposing temperature coefficients.

Figure 3:
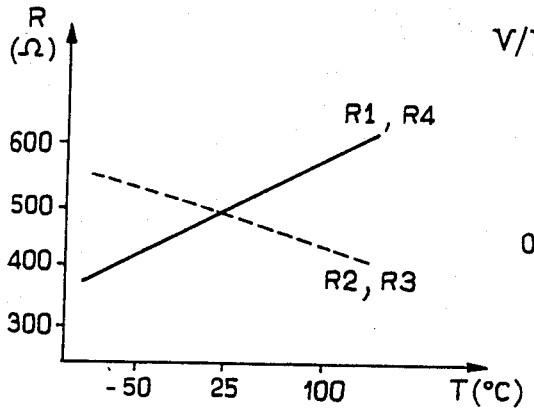
FIG. 3 shows resistance versus temperature curves for measurement sensors.

Resistors R1 to R4 have the same value at $T_0$, but opposing temperature coefficients: R1 and R4 have the same coefficient and are made of e.g. titanium (positive temperature coefficient), while R2 and R3 are made of e.g. tantalum (negative temperature coefficient) opposite to that of R1 and R4. Their resistance versus temperature curves are illustrated in FIG. 3.

In this type of bridge, the voltages at the midpoints A and B, which are equal at the equilibrium point $T_0$, evolve in opposite directions, thereby increasing the output signal value.

The second part of the device is a transistorized differential structure. The load on the two channels is active and thus adaptable to the temperature-controlled circuit.

Transistors T1 and T2 are supplied via a current source T1 between DC1 and ground: the off-equilibrium voltages at points A and B of the resistor bridge are applied to the gates of T2 and T3. The load transistors T4 and T7 serve to provide a good operating point at $T_0$. Transistors T5 and T6, which are controlled by voltages DC3 and DC4, enable the gain of the differential circuit to be controlled in accordance with the circuit to be stabilized. The output voltages are delivered at points V2 and V3 which are respectively the common points of T2 and T5, and T3 and T6. Voltage V2 is supplied e.g. to a transistor gate of the controlled circuit—which is integrated on a common chip—and serves to stabilize the characteristics of the latter if the temperature evolves.

Figure 4:
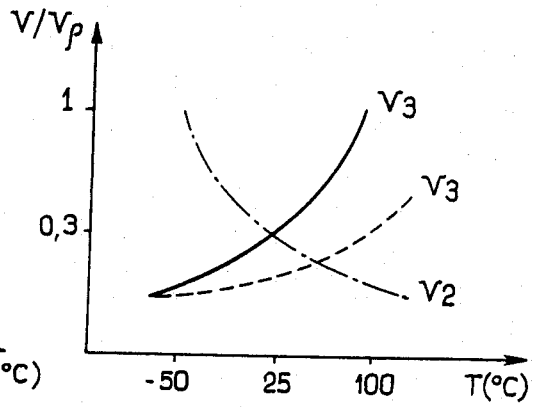
FIG. 4 shows response versus temperature curves for the structure shown in FIG. 2.

The response of the circuit as a function of temperature is illustrated in FIG. 4. Curves V2 and V3 (continuous line) correspond to a balanced response since DC3=DC4. This equilibrium can be displaced by varying either one of the voltages DC3 or DC4, which would then yield e.g. curve V3 (broken line): DC3≠DC4.

The simplified differential structure shown in the circuit diagram can form the basis of a more elaborate design to obtain a linear, parabolic, logarithmic, etc . . . response for V2 or V3 depending on the circuits to be stabilized. The circuit diagrams for the signal shaping part are known in themselves in the field of logic design.

The interest of the above inventive device is that it is fully compatible with the manufacturing stages employed in microwave technology. The circuit occupies little space and can be integrated beside a transistor or varactor of the microwave circuit whose temperature characteristics are to be stabilized.

What is claimed is:

1. A device for controlling temperature characteristics of an integrated circuit supported on a substrate, wherein said device comprises, integrated the same substrate as said integrated circuit to be controlled, a divider bridge formed by four resistors supplied between two stable voltages, said resistors forming pairs of resistors having mutually opposite temperature coefficients, mounted on diagonals of said bridge and delivering at their mid-points two controlling voltages evolving oppositely with temperature.

2. The device as claimed in claim 1, wherein said device further comprises a differential circuit for shaping said controlling voltages, said circuit being formed by two first transistors and associated load transistors and supplied by voltages from said bridge by means of a current source, off-equilibrium voltages of said bridge being applied to gates of said two first transistors, and output voltages being collected at common points between said first transistors and their load transistors.

3. The device as claimed in claim 2, wherein, in order to adjust the gain of said differential circuit in accordance with said integrated circuit to be controlled, said device further comprises two adjustment transistors connected in parallel with said load transistors, adjustment voltages being applied to the gates of said adjustment transistors

* * * * *